US007708455B2

(12) United States Patent
Cabezas Jurin et al.

(10) Patent No.: US 7,708,455 B2
(45) Date of Patent: May 4, 2010

(54) DIRECT IMPULSE ESCAPEMENT FOR TIMEPIECE

(75) Inventors: Andrés Cabezas Jurin, Yverdon-les-Bains (CH); Thierry Conus, Lengnau (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 12/105,447

(22) Filed: Apr. 18, 2008

(65) Prior Publication Data

US 2008/0259738 A1 Oct. 23, 2008

(30) Foreign Application Priority Data

Apr. 18, 2007 (EP) ..... 07106376

(51) Int. Cl.
*G04B 15/00* (2006.01)

(52) U.S. Cl. ..... 368/131; 368/124

(58) Field of Classification Search ..... 368/124–138
See application file for complete search history.

(56) References Cited

U.S. PATENT DOCUMENTS

| | | | | |
|---|---|---|---|---|
| 594,446 | A | 11/1897 | Voigt | |
| 1,037,342 | A * | 9/1912 | Shortill | 368/132 |
| 1,091,261 | A | 3/1914 | Walker | |
| 2,531,273 | A | 11/1950 | Jaccard | |
| 6,301,981 | B1 | 10/2001 | Oechslin | |
| 6,708,576 | B2 | 3/2004 | Oechslin | |
| 6,802,645 | B2 | 10/2004 | Ludwig | |
| 7,097,350 | B1 | 8/2006 | Conus et al. | |
| 7,192,180 | B2 * | 3/2007 | Hayek et al. | 368/127 |
| 7,366,058 | B2 | 4/2008 | Marki et al. | |
| 2005/0128880 | A1 | 6/2005 | Hayek et al. | |
| 2006/0221774 | A1 | 10/2006 | Conus et al. | |

FOREIGN PATENT DOCUMENTS

| | | |
|---|---|---|
| CH | 4698 | 3/1892 |
| CH | 373703 | 1/1964 |
| EP | 0 018 796 | 11/1980 |
| EP | 1 045 297 | 10/2000 |
| EP | 1 367 462 A1 | 12/2003 |
| EP | 1 708 047 | 10/2006 |

OTHER PUBLICATIONS

European Search Report issued in corresponding application No. EP 07 10 6376, completed Jan. 30, 2008.
Office Action issued in related U.S. Appl. No. 12/105,492, mailed Sep. 17, 2008.
Chamberlain, P. M., "It's About Time—The Lever Escapement," 1978, pp. 77-81.
Daniels, George, "La Montre: Principes et Methodes de Fabrication," 1993, pp. 236-248.
Notice of Allowance issued in co-pending related U.S. Appl. No. 12/105,644, dated Jun. 15, 2009.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

The timepiece escapement includes first (3) and second (4) impulse pallet stones secured to the balance (2) directly cooperating with the teeth of the escape wheel set (1) and a brake lever (5) periodically driven by the balance, the brake lever being provided with first (6) and second (7) locking pallet stones arranged for cooperating with the teeth of the escape wheel set (1).

3 Claims, 4 Drawing Sheets

DIRECT IMPULSE ESCAPEMENT FOR TIMEPIECE

This application claims priority from European Patent Application No. 07106376.2, filed Apr. 18, 2007, the entire disclosure of which is incorporated herein by reference.

FIELD OF THE INVENTION

The invention relates to an escapement for a timepiece, including an escape wheel set, driven by a gear train, a balance associated with a balance spring, means using the energy developed by the wheel set for periodically launching the balance and means for temporarily locking said wheel set after each launch of said balance.

BACKGROUND OF THE INVENTION

Most known escapements comply with the very general description that has just been given.

This is the case of the Swiss lever escapement wherein the balance launching and wheel set locking means are united in a pallet assembly including two pallet stones, each of which fulfil both the function of launching the balance and locking the escape wheel set. In this system, the balance receives two impulses by oscillation, not directly, but via the lever assembly inserted between the escape wheel set and the balance.

This is also the case of the coaxial escapement and the single wheel escapement disclosed in the work entitled "La Montre: principes et méthodes de fabrication", by George Daniels, Scriptar Editions S.A., La Conversion, Lausanne 1993, pages 240 to 248. In these escapements, the means for locking the escape wheel set are formed by a pallet assembly including two locking pallet stones. The balance launching means are formed on the one hand by a first impulse pallet stone, arranged on the pallet assembly and on the other hand by a second impulse pallet stone arranged on the balance roller. In these systems, the balance also receives two impulses per oscillation, one indirect via the first pallet stone arranged on the pallet assembly and the other direction via the second pallet stone arranged on the roller.

SUMMARY OF THE INVENTION

Thus, to the knowledge of the authors of this invention, there does not exist an escapement wherein the balance receives two impulses per oscillation, namely one impulse per vibration, these impulses being directly imparted to the balance by the escape wheel set without any intermediate elements. It will be clear than any direct action of the wheel set on the balance can only increase the efficiency of the system since the use of inserted parts is avoided.

This object is achieved by the present invention, which is characterized in that the escapement includes first and second impulse pallet stones secured to the balance and cooperating directly with the teeth of the escape wheel set, and a brake lever driven periodically by the balance, this brake lever being provided with first and second locking pallet stones arranged for cooperating with said teeth of said wheel set.

BRIEF DESCRIPTION OF THE DRAWINGS

The invention will now be explained in detail below via one embodiment, given by way of non-limiting example, this embodiment being illustrated by the annexed drawings, in which.

DETAILED DESCRIPTION OF THE ILLUSTRATIVE EMBODIMENTS

Figure 1:
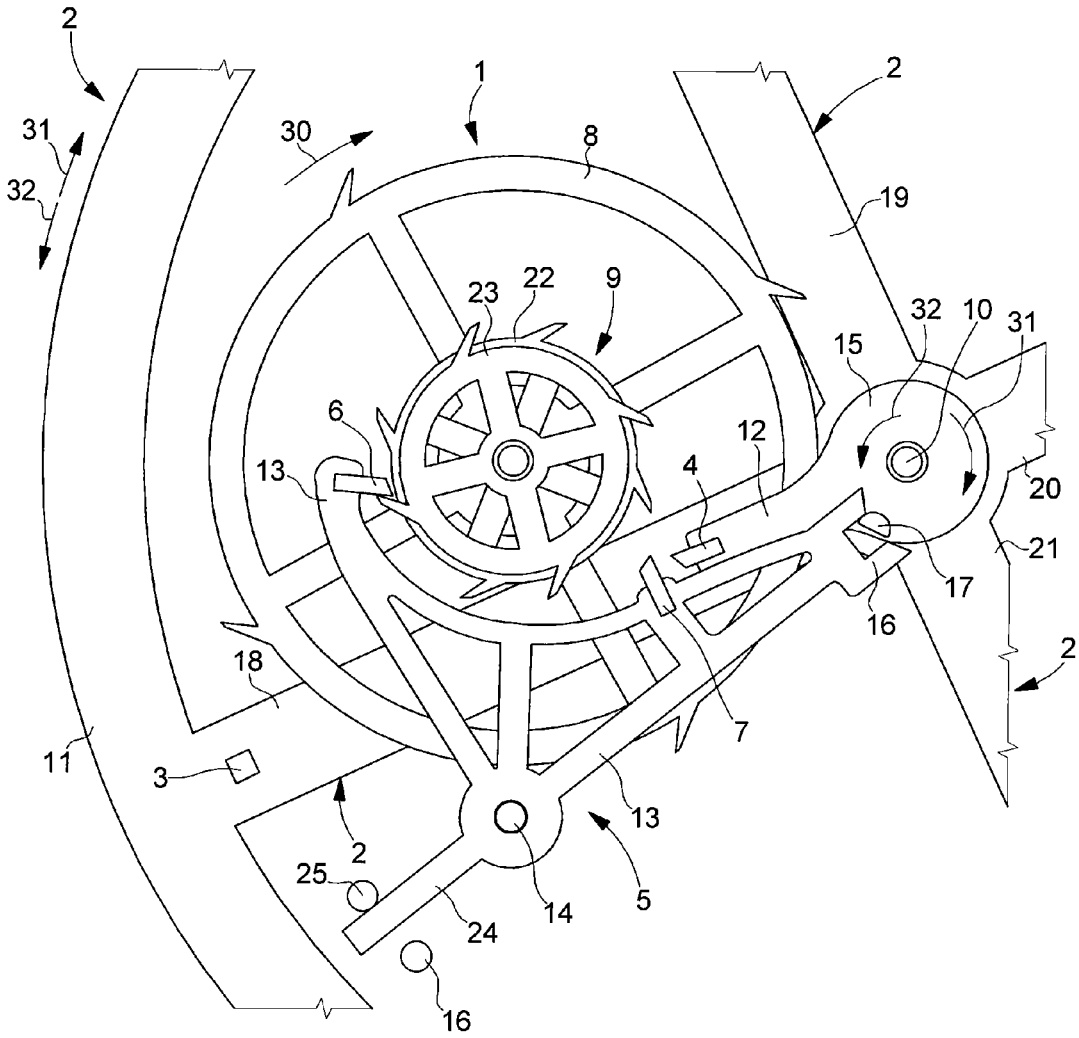
FIG. 1 is a plan view of the escapement according to the invention.

FIG. 1 is a plan view of the escapement mechanism according to a preferred embodiment of the present invention. This escapement includes an escape wheel set 1 driven by a gear train that is not shown in the drawing. This gear train is generally driven by a barrel and rotates, when it is driven, in the direction indicated by arrow 30. The escapement also includes a balance 2 associated with a balance spring that is not shown here. Balance 2 is partially shown by its felloe 11 and four spokes 18, 19, 20, 21. Balance 2 pivots on an arbour 10 and rotates in the direction of arrows 31 or 32 according to the vibration considered.

Means are implemented which use the energy developed by wheel set 1 for periodically relaunching balance 2. These means includes first and second impulse pallet stones 3 and 4, which are secured to the balance 2 and which cooperate directly with the teeth of wheel set 1. Other means are implemented for temporarily locking wheel set 1 after each launch of balance 2. These means consist of a brake lever 5 pivoting on an arbour or pin 14. The brake lever is periodically driven by balance 2 and is fitted with first and second locking pallet stones 6 and 7 arranged for cooperating with the teeth of wheel set 1.

More specifically, and as is shown clearly in FIG. 1, which shows one embodiment selected from among others relating to the invention, the escape wheel set 1 includes a plurality of wheels secured to each other and coaxially mounted on each other, namely in this case, at least one first wheel 8 of large diameter and a second wheel 9 of smaller diameter. The impulse pallet stone 3 is arranged for cooperating with the large wheel 8 and impulse pallet stone 4 is arranged for cooperating with small wheel 9.

It can be shown that the use of two wheels 8 and 9 of different diameter increases the operating reliability of the system. In these conditions, the angle during which one tooth of wheel 8 accompanies impulse pallet stone 3 (see FIGS. 4 and 5) and the angle during which one tooth of wheel 9 accompanies impulse pallet stone 4 (see FIGS. 10 and 11), are considerably larger than if escape wheel set 1 were fitted with a single wheel. Thus, increasing the angle of accompaniment or contact between tooth and pallet stone can only improve the operating security of the entire escapement, since too small an angle leaves no security margin, given the inherent manufacturing tolerances of the mechanical parts implemented here.

FIG. 1 also shows that the first and second locking pallet stones 6 and 7 are arranged for cooperating with the small diameter wheel 9. However, the invention is not limited to this embodiment. Indeed, these locking pallet stones could equally well cooperate with the teeth of the large wheel 8 or even cooperate with an additional wheel entirely dedicated to said pallet stones.

The small diameter wheel 9 of FIG. 1 could be unique and stamped in a single piece. For manufacturing convenience, we have chosen to use two identical wheels 22 and 23 mounted one on top of the other and shifted angularly. (The drawing shows here two slightly different diameters for proper understanding of the assembly).

It will also be observed that the large wheel 8 forming escape wheel set 1 is entirely confined within a space extending between arbour 10 and felloe 11 of balance 2. More specifically, the first impulse pallet stone 3 is located in a peripheral zone of balance 2 which could be felloe 11, but the example embodiment is at the end of one of the spokes 18 of said balance. This arrangement is entirely novel since the balance is used here not only as a time-keeper regulating member, but also, by means of pallet stone 3, as an element for launching itself via one of the teeth of the first large escape wheel 8. As regards the second impulse pallet stone 4, FIG. 1 shows that it is secured to the end of a leg 1 for cooperating with the teeth of the second small escape wheel 9. The other end 15 of this leg 12 is secured in proximity to or around arbour 10 of balance 2. This end 15 of leg 12 could be compared to the roller that is commonly encountered in watchmaking, especially since it is fitted with an impulse pin 17 as will be seen below.

Finally, FIG. 1 shows how brake lever 5, arranged for temporarily locking escape wheel set 1 after each launch of the balance, is made. Brake lever 5 is a lever 13 articulated on an arbour 14. It is fitted with first and second locking pallet stones 6 and 7 arranged for cooperating with the second small escape wheel 9. Brake lever 5 includes a fork 16 arranged for cooperating with an impulse pin 17, which, as seen in the paragraph above, is secured to balance 2 or, more precisely, to send 15 of leg 12, which is itself secured to the balance, said impulse pin 17 being located in proximity to arbour 10 of said balance. FIG. 1 further shows that brake lever 5 is fitted with a tail 24, for limiting its excursion between two banking pins 25 and 26. Fork 16 is normally fitted with a dart which prevents the brake lever accidentally tipping. This dart is not shown in FIG. 1.

The operation of the escapement according to the invention will now be explained. One complete oscillation of balance 2 is illustrated in FIGS. 2 to 14. The various operating phases will be analysed below.

Figure 2:
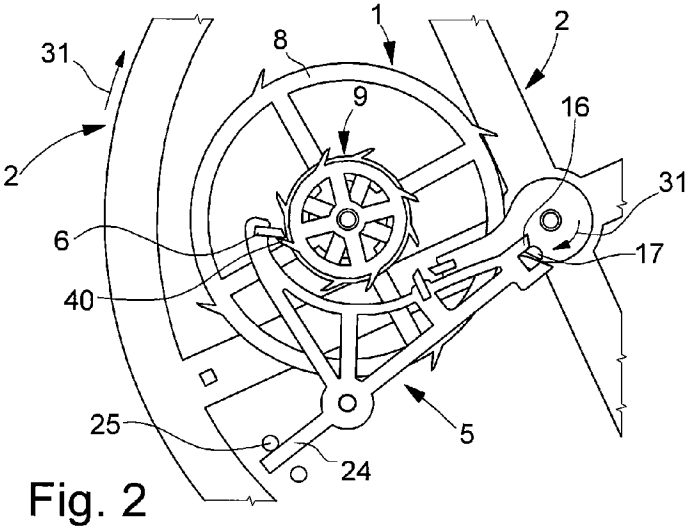

In FIG. 2, the balance is rotating in the direction of arrow 31. The escape wheel set 1 is locked, retained by locking pallet stone 6 which is abutting tooth 40 of the second small wheel 9. The tail 24 of brake lever 5 is abutting against banking pin 25. The impulse pin 17 secured to balance 2 has penetrated fork 16 and entered into contact with one tooth of the fork. This is the start of the unlocking of locking pallet stone 6.

Figure 3:
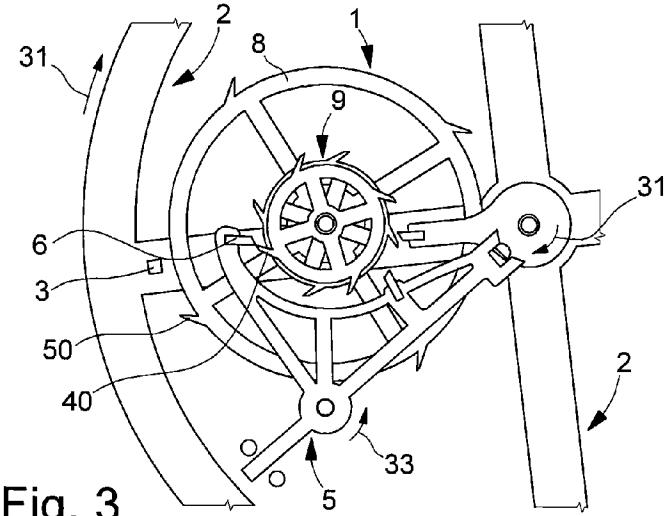
FIGS. 2 to 13 are plan views explaining the operating phases of the escapement according to the invention, these phases covering one complete oscillation of the balance.

As FIG. 3 shows, balance 2 has continued to rotate in the direction of arrow 31 causing brake lever 5 to pivot in the direction of arrow 33. This pivoting brings locking pallet stone 6 to the end of tooth 4 of wheel 9 and causes it to exit the hold of that tooth. This is the release phase of escape wheel set. It will also be noted that while rotating, balance 2 has made the first impulse pallet stone with which it is fitted 3 intersect the trajectory of tooth 50 of the first large wheel 8 forming escape wheel set 1

Figure 4:
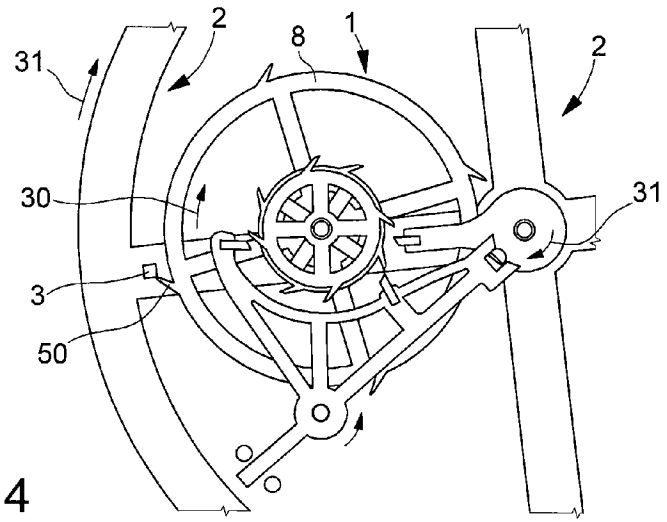

In FIG. 4 escape wheel set 1 is released and is rotating in the direction of arrow 30, actuated by its gear train driven in turn by a barrel. Tooth 50 of the large wheel 8 has caught up with impulse pallet stone 3 secured to balance 2, and then enters into contact therewith. This is the start of impulse phase for launching the balance.

Figure 5:
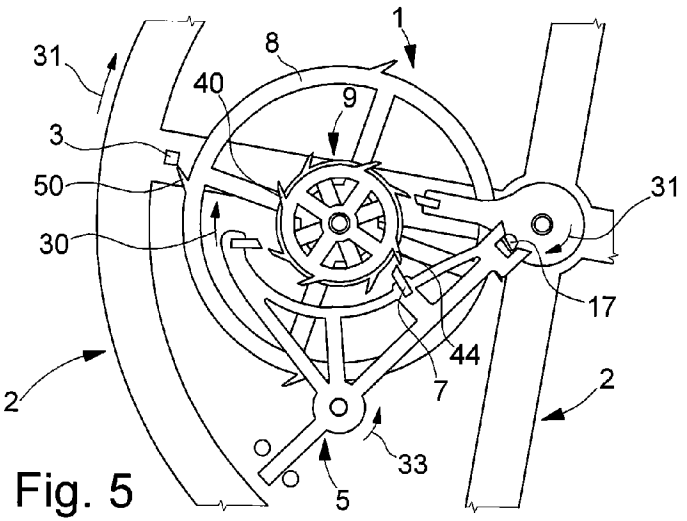

The end of impulse phase is shown in FIG. 5. Escape wheel set 1, rotating in the direction of arrow 30, has brought tooth 50 of the large wheel 8 into the position shown in the Figure, i.e. on the point of letting go. It will be observed that, while rotating, balance 2 has continued to drive, via impulse pin 17 thereof, brake lever 5 in the direction of arrow 33, which consequently causes second impulse pallet stone 7 to intersect the trajectory of tooth 44 of small wheel 9 forming escape wheel set 1, and thus to prepare the next lock.

Figure 6:
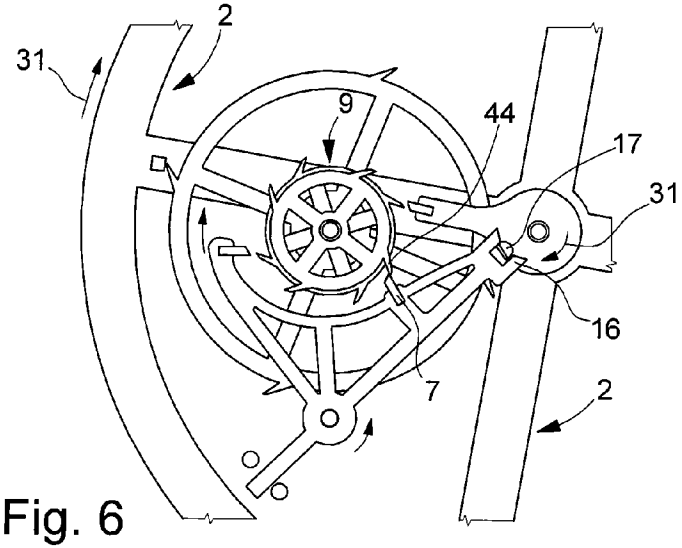

FIG. 6 shows the locking of tooth 44 of small wheel 9 on locking pallet stone 7. Balance 2 continues its rotation in the direction of arrow 31 and impulse pin 17 is on the point of exiting fork 16.

Figure 7:
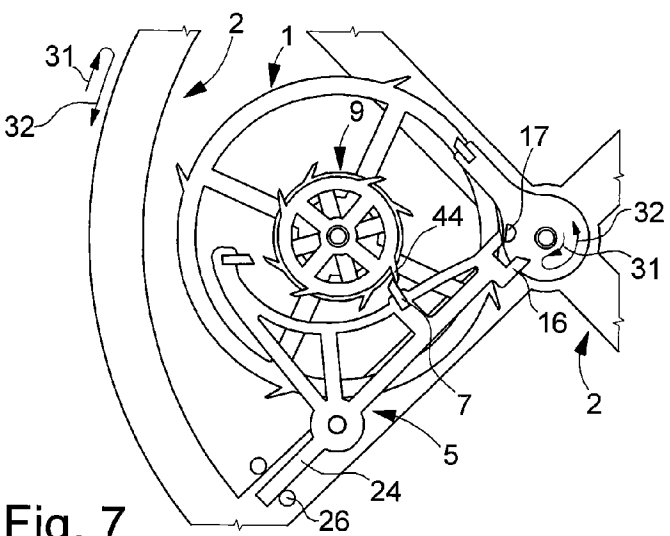

FIG. 7 shows the escapement of the invention in the total locked state. Via the draw effect caused by the torque exerted on wheel set 1, locking pallet stone 7 is pushed further onto the tooth 44 of small second wheel 9 and tail 24 of brake lever 5 then abuts on banking pin 26. From that moment, the balance describes its supplementary arc in the direction of arrow 31, then reverses its direction and retraces its steps along the direction of arrow 32. This marks the end of the first vibration forming the oscillation under examination.

Figure 8:
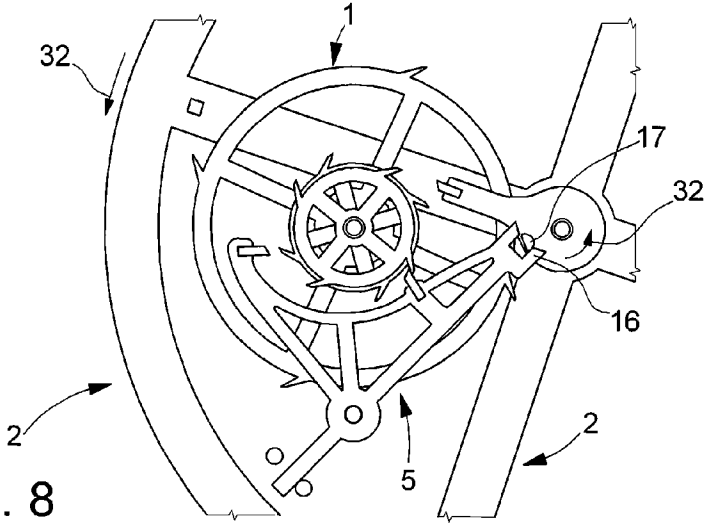

FIG. 8 shows a brake lever 5 in the same situation as that analysed previously. Here, however, as balance 1 is returning in the direction of arrow 32, impulse pin 17 enters into contact with fork 16 of brake lever 5. This is the phase of the start of unlocking of escape wheel set 1.

Figure 9:
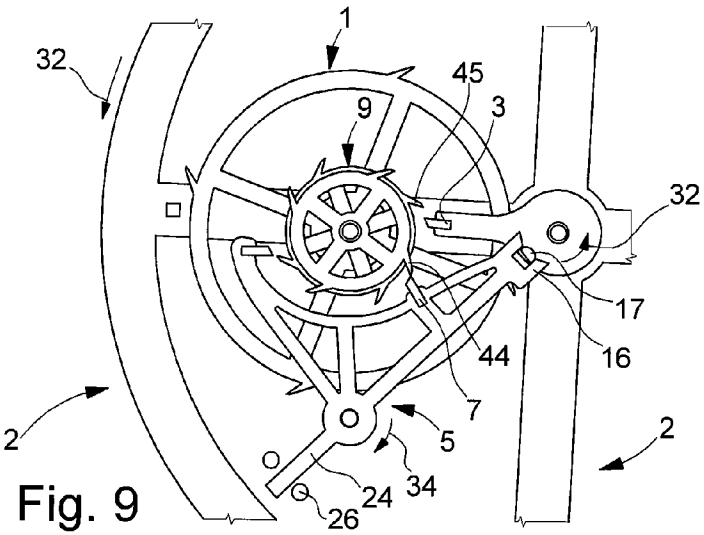

As is clear in FIG. 9, balance 2 has continued its travel in the direction of arrow 32 and, via impulse pin 17 and fork 16, has driven brake lever 5 in the direction of arrow 34. Tail 24 of brake lever 5 has detached itself from banking pin 26 and locking pallet stone 7 has removed itself from the hold of tooth 44 of small wheel 9. This is a release phase of escape wheel set 1. Here again, it will be noted that, while rotating, balance 2 has caused the second impulse pallet stone 4, with which it is fitted, to intersect the trajectory of tooth 45 of small wheel 9 forming escape wheel set 1, which thus prepares the next impulse.

Figure 10:
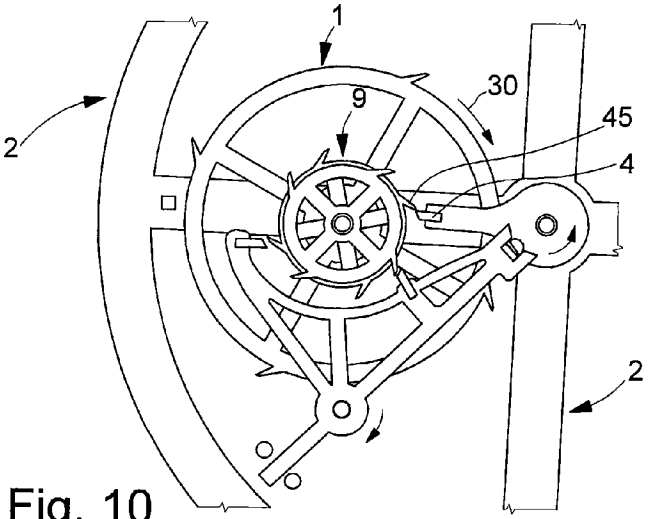

In FIG. 10 escape wheel set 1 is released and is rotating in the direction of arrow 30, actuated by its gear train as stated above. Tooth 45 of small wheel 9 has caught up with impulse pallet stone 4 then enters into contact therewith. This is again a start of impulse phase for launching the balance.

Figure 11:
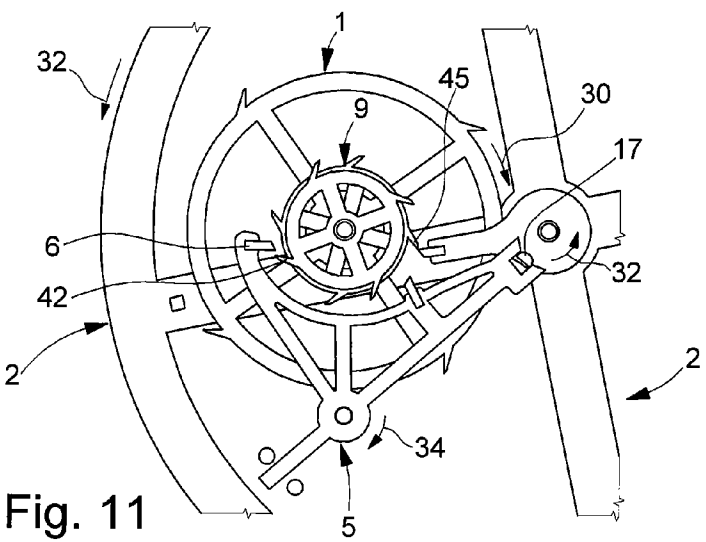

The end of impulse phase is shown in FIG. 11. Escape wheel set 1, rotating in the direction of arrow 30, has brought tooth 45 of small wheel 9 into the position illustrated by the Figure, i.e. on the point of letting go. It will be observed again that while rotating in the direction of arrow 32, balance 2 has continued to drive, via impulse pin 17, brake lever 5 in the direction of arrow 34, which consequently causes first impulse pallet stone 6 to intersect the trajectory of tooth 42 of small wheel 9 and thus to prepare the next lock.

Figure 12:
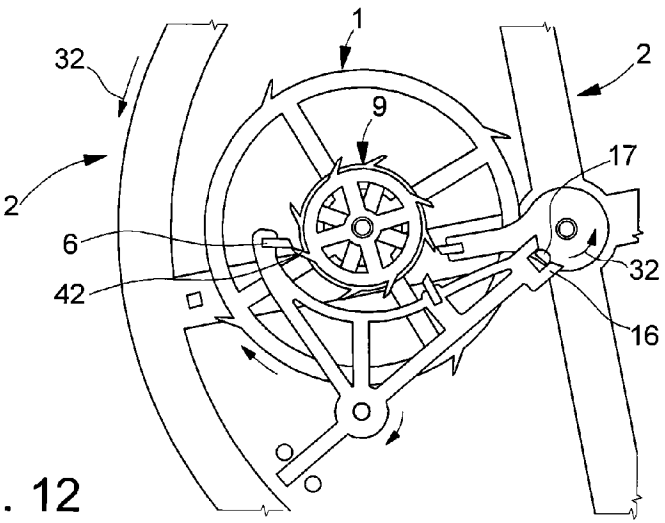

FIG. 12 shows the locking of tooth 42 of small wheel 9 on locking pallet stone 6. Balance 2 continues its travel in the direction of arrow 32 and impulse pin 17 is on the point of leaving fork 16.

Figure 13:
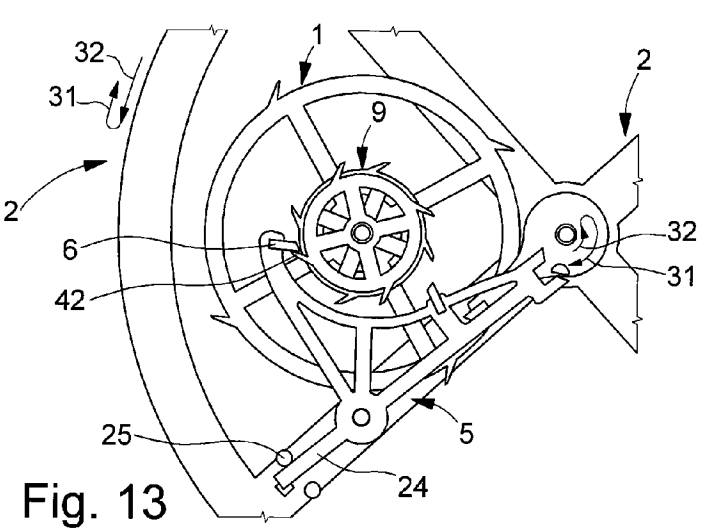

FIG. 13 shows the escapement of the invention in the total lock state. By draw effect locking pallet stone 6 has been pushed more deeply onto tooth 42 of small wheel 9 and tail 24 of brake lever 5 then abuts banking pin 25. From that moment, balance 2 describes its supplementary arc in the direction of arrow 32, then reverses its direction and retraces its steps along the direction of arrow 31. This phase marks the end of the second vibration forming the oscillation under examination. From that moment, a new cycle starts and we return to the situation at the beginning, i.e. that shown in FIG. 2.

What is claimed is:

1. An escapement for a timepiece, including:

(i) an escape wheel set having teeth and driven by a gear train;

(ii) a balance associated with a balance spring;

(iii) means using the energy developed by the wheel set for periodically launching the balance, including first and second impulse pallet stones secured to the balance and cooperating directly with the teeth of the wheel set; and (iv) means for temporarily locking said wheel set after each launch of said balance, including a brake lever driven periodically by the balance, said brake lever being provided with first and second locking pallet stones arranged for cooperating with said teeth of said wheel set, wherein the wheel set includes a plurality of coaxial wheels secured to each other, including at least first and second wheels, the first having a larger diameter than the second, the first and second wheels respectively cooperating with the first and second impulse pallet stones, the first and second locking pallet stones being arranged for cooperating with any of the wheels of the wheel set.

2. The escapement according to claim 1, wherein the first escape wheel is entirely confined within a space extending between the arbour and the felloe of the balance, wherein the first impulse pallet stone is located in a peripheral zone of the balance for cooperating with the first escape wheel and wherein the second impulse pallet stone is secured to the end of a leg whose other end is secured around the arbour of the balance for cooperating with the second escape wheel.

3. The escapement according to claim 1, wherein the brake lever is a lever articulated on an arbour, said brake lever including a fork arranged for cooperating with an impulse pin secured to the balance and located in proximity to the axis of the latter, the first and second locking pallet stones being arranged for cooperating with the second escape wheel.

* * * * *